US010186374B2

(12) United States Patent
Wang

(10) Patent No.: US 10,186,374 B2
(45) Date of Patent: Jan. 22, 2019

(54) MANUFACTURING ND—FE—B MAGNETS USING HOT PRESSING WITH REDUCED DYSPROSIUM OR TERBIUM

(71) Applicant: GM Global Technology Operations LLC, Detroit, MI (US)

(72) Inventor: Yucong Wang, West Bloomfield, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 800 days.

(21) Appl. No.: 14/193,113

(22) Filed: Feb. 28, 2014

(65) Prior Publication Data

US 2014/0271323 A1 Sep. 18, 2014

Related U.S. Application Data

(60) Provisional application No. 61/793,167, filed on Mar. 15, 2013.

(51) Int. Cl.
*H01F 41/02* (2006.01)
*H01F 7/02* (2006.01)

(52) U.S. Cl.
CPC ..... *H01F 41/0266* (2013.01); *H01F 7/02* (2013.01)

(58) Field of Classification Search
CPC ..... H01F 41/0266; H01F 1/03; H01F 7/02; B22F 1/00; B22F 3/24
See application file for complete search history.

(56) References Cited

U.S. PATENT DOCUMENTS

| | | | | |
|---|---|---|---|---|
| 4,076,561 | A * | 2/1978 | Lee | H01F 1/0557 148/103 |
| 5,849,109 | A * | 12/1998 | Ikeda | H01F 1/0573 148/101 |
| 7,608,153 | B2 * | 10/2009 | Tayu | H01F 1/0576 148/101 |
| 8,206,516 | B2 | 6/2012 | Yoshimura et al. | |
| 8,480,815 | B2 | 7/2013 | Wang | |
| 9,468,972 | B2 * | 10/2016 | Wang | B22F 1/025 |
| 2002/0069907 | A1 * | 6/2002 | Yamashita | H01L 35/18 136/205 |
| 2010/0003156 | A1 * | 1/2010 | Suzuki | B22F 1/025 419/10 |

(Continued)

OTHER PUBLICATIONS

Kronmuller et al., "Analysis of the Magnetic Hardening Mechanism in Re—FeB Permanent Magnets", Journal of Magnetism and Magnetic Materials 74 (1988) pp. 291-302.

(Continued)

*Primary Examiner* — Keith Walker
*Assistant Examiner* — John A Hevey

(57) ABSTRACT

A method of making a magnetic material for a permanent magnet using hot-pressing or die-upset methods, or both, by combining two powders and optimizing grain boundary diffusion of Dy or Tb. The method can include making magnetic material for a permanent magnet using hot pressing using a core powder containing Nd, Fe and B and a surface powder containing Dy or Tb in metallic alloy form, combining the materials, forming a solid material in a shaped mold under a magnetic field in vacuum, heating the solid material, hot pressing it to form a magnetic material in a die, heat treating it if necessary, and then cooling it.

14 Claims, 7 Drawing Sheets

(56) References Cited

U.S. PATENT DOCUMENTS

| | | | | |
|---|---|---|---|---|
| 2011/0104476 | A1* | 5/2011 | Toyoda | C22C 33/0207 428/328 |
| 2013/0078369 | A1* | 3/2013 | Shoji | C22C 38/005 427/127 |
| 2013/0084204 | A1* | 4/2013 | Wang | B22F 1/025 419/23 |
| 2014/0184370 | A1* | 7/2014 | Hidaka | C22C 38/06 335/302 |
| 2016/0064144 | A1* | 3/2016 | Wang | H01F 1/0577 419/26 |

OTHER PUBLICATIONS

Herget, "Metallurgical Methods for the Production of Rare Earth-Transition Metal Permanent Magnet Materials", Metal Powder Report, vol. 42, Jun. 1987, pp. 438-444.

Plusa, et al., "Domain Structure and Domain-Wall Energy in Polycrystalline R2Fe14B Compounds", Journal of the Less-Common Metals, vol. 133, 1987, pp. 231-243.

Rosewald, "Magnetization and Aging of Sintered Nd—Fe—B Magnets", Journal of the Less Common Metals, vol. 111, 1985, pp. 77-81.

Machida_et al., "Improved Magnetic Properties of Small-Siced Nd—Fe—B Magnets and Their Application for DC Brush-less Micro-Motors", Coll. Abstr. Magn. Soc. Jpn. 142, 2005, pp. 25-30.

* cited by examiner

MANUFACTURING ND—FE—B MAGNETS USING HOT PRESSING WITH REDUCED DYSPROSIUM OR TERBIUM

CROSS-REFERENCE

This application claims priority to U.S. Provisional Application 61/793,167, filed Mar. 15, 2013.

FIELD

This application relates generally to a method of making a magnetic material for a permanent magnet using hot-pressing or die-upset methods, or both, by combining two powders and optimizing grain boundary diffusion of Dy. The method can also include making magnetic material using hot pressing using a core powder containing Nd, Fe and B and a surface powder containing Dy and/or Tb in metallic alloy form, combining the materials, forming magnetic material in a shaped mold under a magnetic field in a vacuum, heating the magnetic material, hot pressing the magnetic material in a die, and cooling the magnetic material, and heat treat the magnetic material when necessary.

BACKGROUND

Permanent magnets are used in a variety of devices, including traction electric motors for hybrid and electric vehicles, as well as wind turbines, air conditioning units and other applications where combinations of small volumes and high power densities may be beneficial. Sintered neodymium-iron-boron (Nd—Fe—B) permanent magnets have very good magnetic properties at low temperatures. However, due to the low Curie temperature of the $Nd_2Fe_{14}B$ phase in such magnets, the magnetic remanence and intrinsic coercivity decrease rapidly with increased temperature. There are two common approaches to improving thermal stability and magnetic properties at high temperatures. One is to raise the Curie temperature by adding Cobalt (Co), which is completely soluble in the $Nd_2Fe_{14}B$ phase. However, the coercivity of Nd—Fe—B magnets with Co decreases, possibly because of the nucleation sites for reverse domains. The second approach is to add heavy rare earth (RE) elements such as dysprosium (Dy) or terbium (Tb), or both. It is known that the substitution of Dy for Nd or Fe in Nd—Fe—B magnets results in increases of the anisotropic field and the intrinsic coercivity and a decrease of the saturation magnetization. See, for example, C. S. Herget, *Metal, Poed. Rep.* V. 42, P. 438 (1987); W. Rodewald, *J. Less-Common Met.*, V111, P 77 (1985); and D. Plusa, J. J. Wystocki, *Less-Common Met.* V. 133, P. 231 (1987). It is a common practice to add the heavy RE metals such as Dy or Tb into the mixed metals before melting and alloying.

However, Dy and Tb are very rare and expensive materials. Only a small fraction of the RE mines in the world contain heavy REs. The price of Dy has increased sharply in recent times. Tb, which is needed if higher magnetic properties are required than Dy can provide, is even more expensive than Dy. Furthermore, these metals may be difficult to work with in their relatively pure form, where for example pure Dy is too soft to form into a powder, and is also easily oxidized.

Typical magnets for traction electric motors in hybrid electric cars and trucks contain between about 6 and 10 weight percent Dy to meet the required magnetic properties, while other applications (such as the aforementioned wind turbines and air conditioners, as well as other vehicular configurations (such as motorcycles that may not have as high of an operating temperature environment as their car and truck counterparts) may have lower Dy needs. Assuming the weight of permanent magnet pieces is about 1-1.5 kg per electric traction motor, and a yield of the machined pieces of typically about 55-65 percent, 2-3 kg of permanent magnets per motor would be required. Moreover, because other industries compete with permanent magnets for limited Dy resources (thereby exacerbating already high costs associated with such materials), reducing the Dy usage in permanent magnets would have a very significant cost impact, as it would for Tb.

The microstructures of Nd—Fe—B sintered magnets have been extensively investigated in order to improve the magnetic properties of such magnets composed mainly of the hard-magnetic $Nd_2Fe_{14}B$ phase and the nonmagnetic Nd-rich phase. The coercivity is known to be greatly influenced by the morphology of the boundary phases between $Nd_2Fe_{14}B$ grains. The magnetic properties of the Nd—Fe—B sintered magnets are degraded when the magnet size is decreased because the machined surface causes nucleation of magnetic reversed domains Likewise, in their work entitled *Improved Magnetic Properties of Small-Sized Magnets and Their Application for DC Brush-less Micro-Motors*, Coll. Abstr. Magn. Soc. Jpn. 142 (2005), 25-30), Machida et al. found that the degraded coercivity of small-sized Nd—Fe—B sintered magnets can be improved by surface treating the formed magnet with Dy and Tb-metal vapor sorption so that there is a uniformly distributed coating of Dy or Tb on the outside of the formed magnet. While such approaches are helpful in improving the properties of magnets that have been treated with Dy or Tb, they do so at great expense by utilizing much of these precious materials.

Current embodiments provide advantages over sintering methods and provide for hot pressing and/or die-upset methods to increase Dy distribution along the grain boundary and to increase the non-uniformity of Dy distribution.

SUMMARY

Specific embodiments provided herein describe method of making a magnetic material for a permanent magnet using hot pressing comprising: providing: a first material in the form of a core powder containing Nd, Fe and B; a second material in the form of a surface powder containing Dy, Tb, or both in metallic alloy form; combining the first material with the second material so that a coated, composite-like material is formed with a non-uniform distribution of the Dy or the Tb that makes up the second material; forming the magnetic material in a shaped mold under a magnetic field in a vacuum; heating the magnetic material from a first range of about 5° C. to about 35° C. to a second range of about 500° C. to about 850° C.; hot pressing the magnetic material in a die; and cooling the magnetic material in the vacuum under inert atmosphere for from about 1 to about 5 hours.

Additional specific embodiments provided herein describe a method of making a magnetic material for a permanent magnet using die-upsetting comprising: providing: a first material in the form of a core powder containing Nd, Fe and B; a second material in the form of a surface powder containing Dy, Tb or both in metallic alloy form; combining the first material with the second material so that a coated, composite-like material is formed with a non-uniform distribution of the Dy or the Tb that makes up the second material; forming a solid material in a shaped mold; heating the solid material from a first range of about 5° C.

to about 35° C. to a second range of about 550° C. to about 900° C.; deforming the solid material from about 20 to about 80 percent to form a magnetic material; and cooling the magnetic material in the vacuum under inert atmosphere for from about 1 to about 5 hours.

Yet additional specific embodiments provided herein describe a method of making a magnetic material for a permanent magnet using hot pressing and die-upsetting comprising: providing: a first material in the form of a core powder containing Nd, Fe and B; a second material in the form of a surface powder containing Dy in metallic alloy form; combining the first material with the second material so that a coated, composite-like material is formed with a non-uniform distribution of the Dy that makes up the second material; forming a solid material in a shaped mold; heating the solid material from a first range of about 5° C. to about 35° C. to a second range of about 500° C. to about 850° C.; hot pressing the solid material in a die; heating the solid material after the hot pressing to a third range of about 550° C. to about 900° C., wherein the heating is performed after the hot pressing; deforming the solid material from about 20 to about 80 percent to form a magnetic material; and cooling the magnetic material in the vacuum under inert atmosphere for from about 1 to about 5 hours.

DETAILED DESCRIPTION

Figure 1:
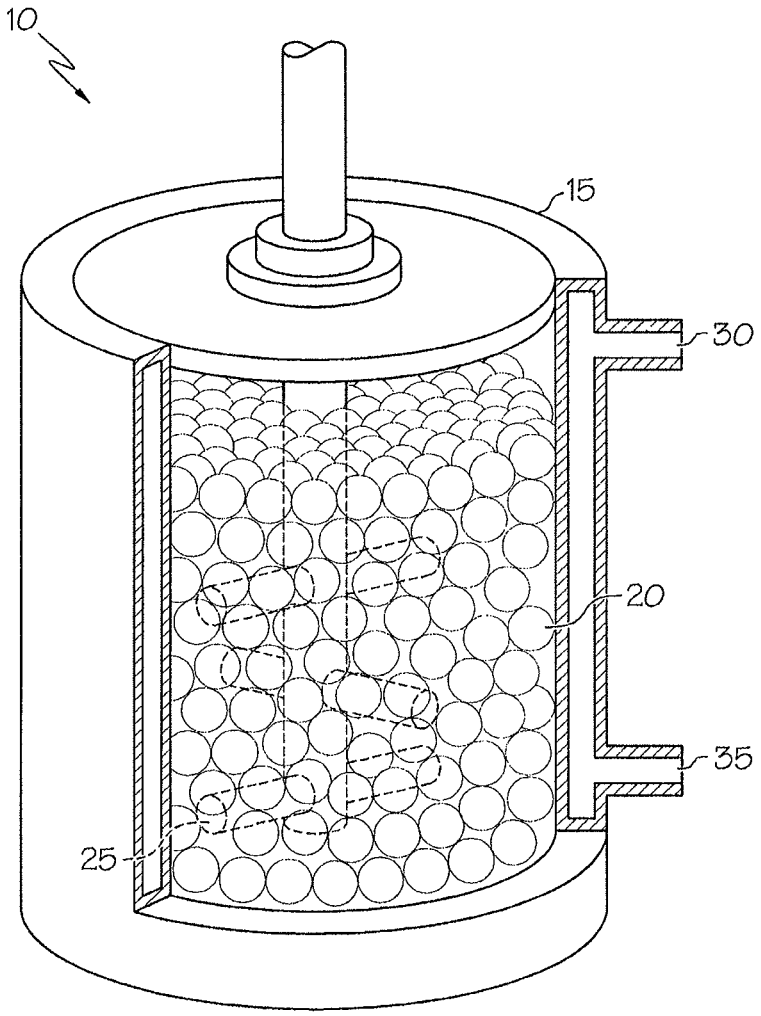
FIG. 1 is a schematic of a mechanical mill.

Specific embodiments of the present disclosure will now be described. The invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which embodiments of this invention belong. The terminology used herein is for describing particular embodiments only and is not intended to be limiting of the invention. As used in the specification and appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, and so forth as used in the specification and claims are to be understood as being modified in all instances by the term "about," which is intended to mean up to ±10% of an indicated value. Additionally, the disclosure of any ranges in the specification and claims are to be understood as including the range itself and also anything subsumed therein, as well as endpoints. Unless otherwise indicated, the numerical properties set forth in the specification and claims are approximations that may vary depending on the desired properties sought to be obtained in embodiments of the present invention. Notwithstanding that numerical ranges and parameters setting forth the broad scope of embodiments of the invention are approximations, the numerical values set forth in the specific examples are reported as precisely as possible. Any numerical values, however, inherently contain certain errors necessarily resulting from error found in their respective measurements.

As used herein, the term "room temperature" refers to a range of about 5° C. to about 35° C.

As used herein, the term "flake-shaped powder" refers to a flake having an aspect ratio of width to thickness of about 5 to about 40. In specific embodiments the surfaces of the flake can be curled.

The current invention involves manufacturing processes that reduced the need for excessive amounts of Dy or other heavy rare earths (HRE) in Rare Earth/Transition Metal/Boron (RE2TM14B, such as Nd2Fe14B)-based magnets through the processes' impact on the final microstructure and chemical homogeneity in the magnet material. Magnets manufactured in the conventional manner require up to 10 wt % HRE in order to maintain a sufficient resistance to demagnetization (coercivity, "Hc") while projecting a large magnetic flux (residual induction "Br") at the elevated temperatures (about 150° C.) seen by magnets used in hybrid and electric automobile motors. A cost-effective manufacturing process can be demonstrated that results in the needed Hc and Br with much less HRE. This is accomplished through selective enrichment of only the boundaries of the (Nd2Fe14B) grains with small amount of HRE present with magnetic isolation of individual (Nd2Fe14B) grains.

The manufacturing processes developed here are based upon lower temperature (about 500° C. to about 1000° C.) consolidation and hot-deformation. The lower temperature hot-pressing or hot pressing plus deformation manufacturing approach used here is different than the conventional sintering approach (shorter process time, lower process temperature with required pressure). HRE grain boundary enrichment processes based upon diffusion from a surface source of HRE has been demonstrated (so called grain boundary diffusion process). The manufacturing approach here is innovative in that it is a bulk material manufacturing approach to simultaneously engender grain boundary enrichment and magnetic isolation without the need for inefficient surface-source diffusion processes. The approach taken here employs hot-pressing with subsequent aging to reduce the temperature and time needed for the sintering and heat treatment process to enhance grain boundary diffusion and minimize bulk diffusion of Dy and/or Tb to maximize the reduction of Dy and/or Tb to achieve the same required magnetic properties. This new approach also results in a significant addition to the bodies of knowledge concerning the thermodynamics (Nd2Fe14B)-(RE-rich eutectic) systems, the kinetics and physics governing the precipitation-dissolution processes operative in the hot pressing and deformation process, and the extent to which microstructures can be engendered resulting in (Nd2Fe14B) permanent magnets that retain a resistance to demagnetization at high temperatures.

The present invention relates generally to electric motors and their manufacture, and more particularly to methods for forming permanent magnets that use rare earth (RE) elements for improved power density of electric motors, especially the heavy rare earth elements such as Dy, Tb etc. for improved high temperature magnetic properties.

U.S. application Ser. No. 13/007,203, filed Jan. 14, 2011, entitled *Method Of Making Nd—Fe—B Sintered Magnets With Dy Or Tb* (hereinafter the '203 application, and now U.S. Pat. No. 8,480,815), which is assigned to the assignee of the present invention and is incorporated herein in its entirety by reference, describes magnets and three methods of making them that use much less Dy or Tb than those made using the conventional methods while obtaining similar magnetic properties. The present inventor has discovered ways to further improve the microstructures, improve the magnetic properties with further reduced HREs through hot pressing and heat treatment processes. Such improvements are the subject of the present invention.

Sintered (Rare Earth)-Fe—B permanent magnets are essential components in electric motors for hybrid electric vehicles (HEVs) and electric vehicles (EVs) because of their high maximum energy product $(BH)_{max}$ and high coercivity as compared to other magnet. The coercivity ($H_c$) and squareness of the BH curve are important considerations as the demagnetizing fields during electric motor operation are significant. The standard chemistry for room temperature applications of sintered permanent magnets is based on Nd—Fe—B ternary with the major phase having stoichiometry of Nd2Fe14B. Unfortunately, the temperature of operation for permanent magnets in vehicle is approximately 160° C. and the BH product for the Nd—Fe—B chemistry will drop drastically above 100° C. (2) due to the low Curie temperature (313° C.), leading to a reduction of the saturation magnetization and coercivity with increasing temperature.

$Dy_2Fe_{14}B$ and $Tb_2Fe_{14}B$ have higher Curie temperature and higher anisotropy constants than $Nd_2Fe_{14}B$. The Curie temperature is 585 K, 602 K, and 639 K for $Nd_2Fe_{14}B$, $Dy_2Fe_{14}B$, and $Tb_2Fe_{14}B$, respectively. In order to maintain high coercivity at elevated operating temperature environments as in hybrid electric vehicle engines, the addition of large amount of heavy rare earth elements such as Dy is substituted for Nd, creating a $(Dy_xNd_{(1-x)})_2Fe_{14}B$ alloy, leading to an increase of the Curie temperature and coercivity. However, the disadvantage of substituting Nd with heavy rare earth (RE) elements is that it reduces the remanence of the magnets. This is because they couple antiferromagnetically with the Fe in the $RE_2Fe_{14}B$ lattice. In addition, availability of heavy rare earth elements on the free market is currently threatened. Therefore, efforts have been initiated to produce heavy rare earth lean magnets that have large coercivity, and that are good, high temperature energy products.

Elevated temperature destruction of magnetic performance is exacerbated by defects such as cracks, oxide particles, triple junctions and grain boundaries that have low magnetic anisotropy and act as nucleation site of reversed magnetic domains. Both U.S. Pat. No. 8,480,815 B2 and Hitachi Process (U.S. Pat. No. 8,206,516) are designed to locally increase the Dy content on the grain boundaries of Nd2Fe14B based permanent magnets, placing the heavy rare earth where it is most needed. Although there are differences in the processing route and resulting microstructure uniformity between the proposed approach and the Hitachi process, the two approaches share a common scientific basis of enriching Nd2Fe14B grain boundaries with heavy rare earth (Dy). Magnetic moment reversal initiates by grain boundary nucleation of reversing domains. Adding Dy to Nd2Fe14B may produce a (Nd,Dy)2Fe14B alloy with increased coercivity, especially at elevated temperature. Dy can be conserved while producing a high coercivity magnet if the formation of (Nd,Dy)2Fe14B alloy occurs only at the grain boundary. Dy is an expensive element and needs to be conserved to reduce the cost of high temperature magnets.

The correlation between coercivity and microstructures was extensively studied in the 1980s by using the detailed analysis of structures and micromagnetism theory (H. Kronmüller and M. Fähnle, *Micromagnetism and the Microstructure of Ferromagnetic Solids*_Cambridge University Press, Cambridge, 2003_, H. Kronmüller, K.-D. Durst, and M. Sagawa, J. Magn. Magn. Mater. 74, 291_1988)). The mechanism responsible for reversing the magnetization of sintered magnets at room temperature was found to be of the nucleation type. The damaging effects of microstructures on coercivity Hci, i.e., misaligned grains, magnetically coupled grains, magnetically perturbed grain surfaces, and the large local demagnetizing stray fields at the sharp corners and edges of polyhedral grains, were considered as phenomena to aid in the nucleation of domains in response to the field reversal.

This type of 'core shell' structure has been studied recently by a large variety of authors who propose an advantage in improving Hci with relatively small Dy additions. The majority of these studies have used diffusion of Dy from the surface of bulk Nd2Fe14B based magnets along the boundaries to produce Dy grain surface enriched microstructures.

The Hitachi process (U.S. Pat. No. 8,206,516) produces the grain boundary enrichment of heavy rare earth by diffusion from the surface of a bulk magnet. This is a post sinter process that occurs in a vapor deposition system. The diffusion of Dy from the surface of the bulk magnet is localized to the grain boundaries because the diffusion coefficient of the boundary is many orders of magnitude higher than that in the bulk. The GM proposed process is designed to offer an alternative to the Hitachi Process as an economically superior method to increase the Dy content on the grain boundaries of Nd2Fe14B based magnetic materials. The current method is economically advantageous because the Dy distribution on the grain boundaries occurs during the powder metallurgy and hot forming processing via internal Dy sources rather than post heat treating via external Dy sources (Hitachi) and does not require numerous excessive equipment or a lengthy additional process step.

The efficacy of the grain boundary enrichment approach was supported by the Hitachi patent (U.S. Pat. No. 8,206,516). The Hitachi investigators first demonstrated an increase in coercivity using the vapor phase deposition/grain boundary diffusion process, and then showed how the coercivity would decrease as the effected thickness was removed. The authors propose that this is an indication of the Dy penetration depth at 900° C. for 240 minutes, effecting the grain boundary Dy composition and thus magnetic behavior at up to approximately 1 mm depth. The Hitachi process has a limit on the magnet thickness that can be treated.

The invention here involves a systematic approach to developing a hot pressing (under magnetic field for grain alignment) and/or hot pressing plus hot-deformation manufacturing process (die-upset) that leverages the microstructure and stoichiometry dependence of thermodynamic, kinetic, and magnetic phenomena in the (RE2TM14B)-(RE-rich eutectic) system to sharply reduce the need for Dy and other HRE in magnets that retaining and even increasing their large Hc and Br at elevated temperatures. The eutectic phases magnetically isolate the individual NdE2Fe14B grains in the bulk material result in the dramatic increase of Hc.

One aspect of the invention is a method of making magnetic material for a permanent magnet. In one embodiment, the method includes combining a first material (which may be in the form of a core powder) containing Nd, Fe and B with a second material (which may be in the form of a surface powder or flake) containing one or both of Dy or Tb in metallic alloy form so that a coated, composite-like material is formed with an inhomogeneous (or non-uniform) distribution of the Dy or Tb that makes up the second material; this ensures the presence of a surface concentration of Dy, Tb or both that is in excess of their bulk concentration while keeping the overall usage low. In specific embodiments the Dy and/or Tb concentration is much higher on the grain surface than in the bulk; in specific embodiments the Dy and/or Tb concentration is about 10 to about 50 weight percentage on the grain surfaces, or much higher on the grain surface than in the bulk. In specific embodiments herein an end product resulting from methods described herein can have this aspect.

Within the present context, a non-uniform or inhomogeneous distribution refers to that where the second material is distributed or concentrated at discrete locations of the first material—such as at the interfaces or grain boundaries or other locations on a surface—with little or none (such as by diffusion, chemical combing or the like) inside the particles that make up the first material.

In one form, the Dy- or Tb-containing alloy may be in small powder form, while in another, the material may be in a larger flake-based form; details associated with these size differences are discussed at more length below. Regardless of the form, they may be used for blending, mixing and mechanically coating to produce the composite-like material. Powder and flake-shaped powder can be made by using atomization (molten metal meeting high pressure inert gas (such as argon) to form particles) or by slip casting followed by hydrogen decrepitation and dehydrogenation.

Significantly, a magnetic material produced according to the present invention may be hot pressed in such a way as to keep diffusion low and thereby preserve the desired inhomogeneous content of one or both of Dy and Tb around the grain boundary areas (also referred to herein as grain boundary surface). In one form, the magnetic material and/or permanent magnet has a grain boundary surface concentration of between about 10 weight percent and about 50 weight percent of Dy, Tb or both.

Embodiments described herein employ changes in temperature, pressure, time, spatial configuration and chemistry in order to change the diffusion or related transport properties of Dy and Tb, as well as various other elements such as Nd, Pr, Gallium (Ga), B, Fe, Co, Al, Cu or the like. In one particular form, mechanical wrapping of the coating material around the coated material may take place by adjusting these parameters, where more complete wrapping can be achieved with higher energy levels, although the wrapping does not need to be complete in order to demonstrate improved performance. In such case, partial wrapping may also be acceptable in certain circumstances due to the diffusion of one or more of the above elements at elevated temperatures and pressures. By controlling the milling and mixing kinetics, new and different material phases may be formed. Additional improvements may occur as a result of adding some elements separately (either in individual form or as part of a binary or ternary alloy) during the process. Such improvements specifically help promote the selective formation of new phases or phase with different elemental content such as mentioned above. These phases may include the eutectic phases around grain boundaries with one or more of the various elements mentioned above, such as Nd- and Dy-rich triple-junction phases. These phases (which, from the phase diagrams, are mostly eutectic phases with multiple elements) may play important roles in improving (i.e., increasing) coercivity ($H_{cJ}$) or other magnetic properties. From their morphology, they can be called triple- (or multiple-) junction phases because they are located around grain boundaries, especially around the junction regions where three or (multiple) grains meet.

A second aspect of embodiments herein described involve a method of making an Nd-based permanent magnet with an inhomogeneous dispersion of at least one of Dy or Tb by mechanically milling an Nd—Fe—B-containing powder-based material and a flake-based material containing at least one of Dy and Tb such that the powder-based material is substantially coated with a layer of the flake-based material. After the milling, excess parts of the flake-based material that didn't coat the coated powder-based material could be removed by screening, after which the coated composite-like material is formed into a predetermined shape under a magnetic field for powder alignment. This shaped part is then pressed at elevated temperatures such that the part is formed where the flake-based material used to coat the underlying powder-based material may remain in the material and is distributed in a non-uniform way. In one form, such non-uniformity is through preferential accumulation at the grain boundaries of the underlying powder-based material, or by eutectic phase formation during heat treatment.

A third aspect of embodiments herein described involves a method of making an Nd-based permanent magnet with an inhomogeneous dispersion of at least one of Dy or Tb. The method includes mechanically milling a first powder-based material containing Nd—Fe—B and a second powder-based material containing at least one of Dy and Tb such that the first powder-based material is substantially mixed and coated with a layer of the second powder-based material. This coated powder is then formed into a predetermined shape under a magnetic field and then heated and pressed such that the magnet part is formed with the second powder-based material being distributed in a non-uniform way on a surface of the first powder-based material. Such non-uniformity may be through preferential accumulation at the grain boundaries of the elements, especially Dy, Tb and/or other RE elements, or by eutectic phase formation. Embodiments of magnetic material or permanent magnets produced herein may be small or large; in specific embodiments magnetic material or permanent magnets can be from a fraction of a cubic inch in size to one, or even several cubic inches in size or from about one or more cubic feet in size; in specific embodiments the magnetic material or permanent magnet can be placed in an electric motor, and can be placed in a rotor or stator; in specific embodiments the shape can for example be round or rectangular or disk shaped, or another shape for the material known in the art.

Magnets made using the present process use much less Dy or Tb than those made using the conventional methods while obtaining similar magnetic properties. In the present process, the Dy or Tb coated Nd—Fe—B powders are used to make the magnet, which results in a non-uniform distribution of Dy or Tb in the magnet, which can be seen and measured using a scanning electron microscope with a microprobe. This enables the present process to use much less Dy or Tb for the similar magnetic properties. For example, the amount of Dy and/or Tb can be reduced by about 20% or more compared to conventional processes, or about 30% or more, or about 40% or more, or about 50% or more, or about 60% or more, or about 70% or more, or about 80% or more, or about 90% or more. By non-uniform distribution, we mean that Dy and/or Tb are distributed or concentrated at the interface of the powder particles, with little or none inside the particles.

Using these methods, the Dy and/or Tb coating thickness can be from about one micrometer to about 100 micrometers, for example, from about 2 to about 100 micrometers, or from about 5 to about 90 micrometers, or about 5 to about 80 micrometers, or from about 5 to about 70 micrometers, or from about 5 to about 60 micrometers, or from about 10 to about 50 micrometers.

The powder coating process allows the average Dy and/or Tb concentration to be reduced and changes the distribution of the Dy and/or Tb in the magnet. The average Dy and/or Tb concentration of the magnet can be in a range of about 0.3 to about 6 wt %, or about 0.3 to about 5 wt %, or about 0.3 to about 4 wt %, or about 0.3 to about 3 wt %, compared with about 6 to 9 wt % for traditional magnets having similar high magnetic properties. The coating process creates powder particles with a Dy and/or Tb surface concentration as high as about 5 to about 80 wt. % or more, and a low Dy and/or Tb bulk concentration (i.e., inside the particles). Dy and/or Tb could be intentionally added or partially diffused into the powder particle from the particle surface, if desired. However, the bulk concentration of Dy and/or Tb inside the particles is less than the surface concentration of Dy and/or Tb. The coating process is introduced into the current preparation for the powder metallurgy process as an extra step.

Dy or Tb or both can be used, as desired. If Tb is included, not as much Dy is needed. For example, the combination of Dy and Tb could be less than about 6 wt %. Tb can be much more effective than Dy in improving magnetic properties. However, this should be balanced against the significantly higher cost of Tb. A ratio of Dy to Tb of up to about 10 can be used if desired.

The Dy or Tb concentration distribution feature can be manipulated by various heat treatments of the magnets, especially annealing schedules. A longer time or higher temperature can make the distribution wider and less concentrated at the particle surface.

In various embodiments some or all of the following steps can be used: The magnet manufacturing process can include: 1) melting and strip casting, 2) hydrogen decrepitation (hydride and de-hydride), 3) pulverizing (with nitrogen), 4) mixing alloy powder to adjust the chemical composition and optional screening, 5) coating the powder with Dy and/or Tb rich powder, and 6) optional screening. Screening, in specific embodiments, can include a mesh or meshes of one or more sizes to remove excess powder. This can be followed by forming under a magnetic field and a hot-pressing process and machining to magnet pieces. Finally, the magnets can be surface treated (e.g., phosphate, electroless Ni plating, epoxy coating, etc.)

The three coating methods described above will be discussed in more detail.

Mechanical alloying is a solid-state powder processing technique involving repeated welding, fracturing, and rewelding of powder particles in a high-energy ball mill. It can be used to synthesize a variety of equilibrium and non-equilibrium alloy phases starting from blended elemental or pre-alloyed powders. The non-equilibrium phases synthesized include supersaturated solid solutions, metastable crystalline and quasicrystalline phases, nanostructures, and amorphous alloys.

Mechanical alloying uses a high energy mill to favor plastic deformation required for cold welding and to reduce the process times. It allows a mixture of elemental and master alloy powders to be used. The use of master alloy powders reduces the activity of the element because it is known that the activity in an alloy or a compound could be orders of magnitude less than in a pure metal. Mechanical alloying eliminates the use of surface-active agents which would produce fine pyrophoric powder as well as contaminate the powder. It relies on a constant interplay between welding and fracturing to yield a powder with a refined internal structure, typical of very fine powders normally produced, but which has an overall particle size which is relatively coarse, and therefore stable.

The mechanical alloying process starts with mixing the powders in the desired proportion. The powder mix is loaded into the ball mill along with the grinding medium (e.g., steel balls). The powder mixture is then milled for the desired length of time. The important components of the mechanical alloying process are the raw materials, the mill, and the process variables. Parameters include the type of mill, the milling container, milling speed (generally about 50 to about 400 rpm, typically about 250 rpm), milling time (generally about 0.5 to about 12 hours), the type, size, and size distribution of the grinding medium (e.g., hardened steel, stainless steel etc.), ball-to-powder weight ratio (generally about 1:1 to as high as about 220:1, with about 10:1 being typical), the extent of filling the vial, the milling atmosphere (e.g., vacuum, nitrogen, or argon), and temperature of milling (generally about room temperature to about 250° C.).

The raw materials used for mechanical alloying can have particle sizes in the range of about 1 to about 200 micrometers (μm) in diameter. The powder particle size is not critical, except that it should be smaller than the grinding ball size, because the powder particle size decreases exponentially with time and reaches a few microns after only a few minutes of milling. The raw powders can be pure metals, master alloys, or pre-alloyed powders.

Different types of high-energy milling equipment can be used to produce mechanically alloyed powders. They differ in their capacity, efficiency of milling, and additional arrangements for cooling, heating, etc. A conventional ball mill 10 includes a rotating horizontal drum 15 partially filled with small steel balls 20, as shown in FIG. 1. As the drum 15 rotates, the balls 20 drop on the metal powder that is being ground. The grinding tanks or containers are available in stainless steel or stainless steel coated inside with alumina, silicon carbide, silicon nitride, etc., for example. The ball mill 10 includes a rotating impeller 25. Coolant flows through the jacket of the drum 15 from an inlet 30 to an outlet 35 to control the temperature of the powder during milling.

Figure 2:
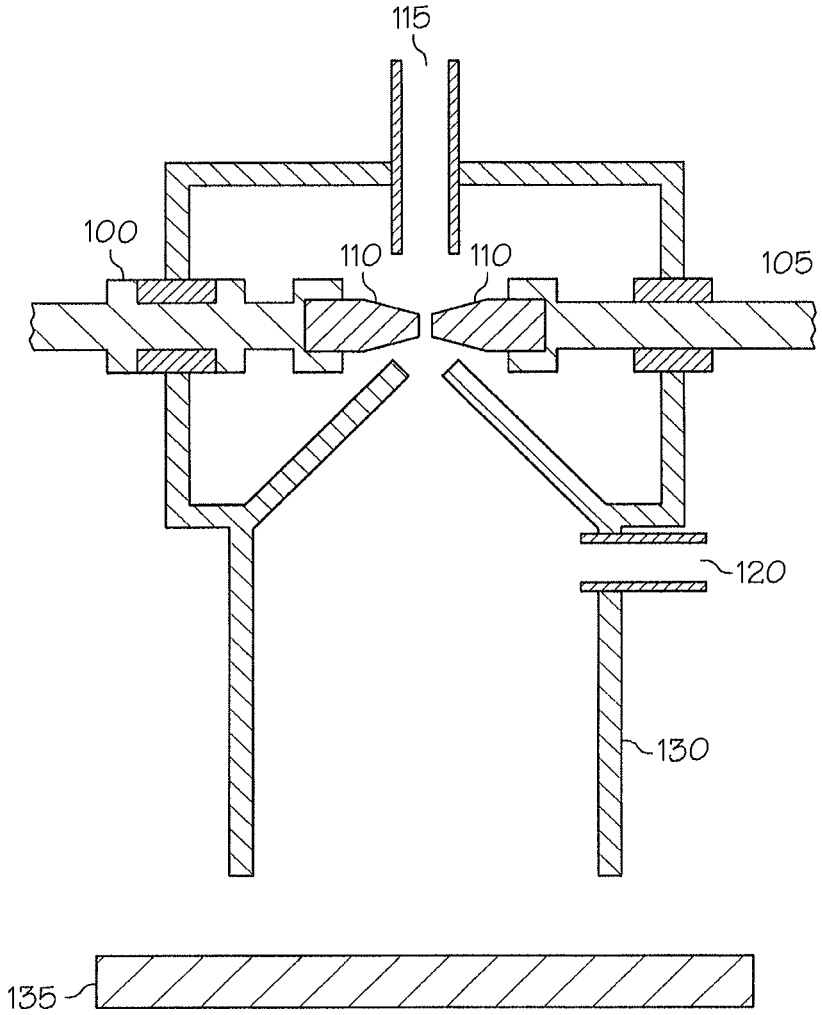
FIG. 2 is a schematic of a particle gun based on spark erosion.
Figure 3:
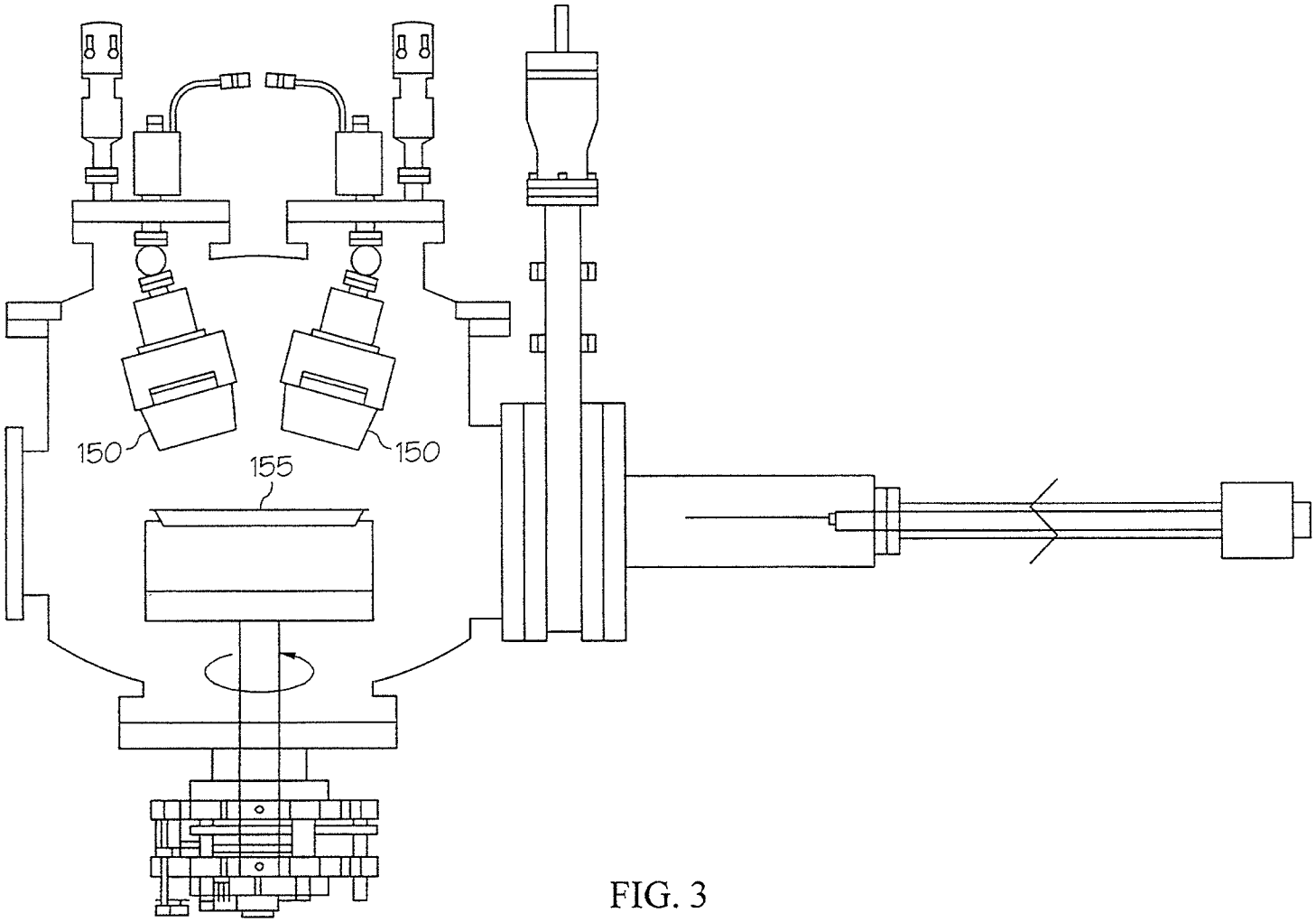
FIG. 3 is a schematic of a particle gun based on high pressure sputtering.

Another method involves coating the Nd—Fe—B based powders with Dy or Tb metal using physical vapor deposition (PVD). PVD methods using a particle gun based on spark erosion and sputtering are illustrated in FIGS. 2-3, although other PVD processes could be used if desired. The "substrate" can be located on the bottom. The substrate is basically a container containing the Nd—Fe—B powders to be coated. If desired, there can be a mixer (not shown) in the container to stir the powders to ensure a uniform coating on the powders.

FIG. 2 illustrates a spark erosion PVD process. There is a fixed electrode holder 100 and an moveable electrode holder 105. The fixed electrode holder 100 is connected to an electrical power supply (not shown). The moveable electrode holder 105 is connected to an electrical power supply and a mechanical oscillator (not shown). The fixed electrode holder 100 and moveable electrode holder 105 have electrodes 110. A carrier gas inlet 115 introduces a carrier gas. A treatment gas inlet 120 introduces a treatment gas into the carrier gas, and structure 130 is shown adjacent the gas inlet 120. The coating material is directed to the substrate 135.

A sputtering PVD coating process is shown in FIG. 3. There are two magnetron sputter sources 150 on the top directed toward the rotating substrate table 155 on the bottom. In sputtering, atoms are ejected from the surface of a target material (Dy and/or Tb or the alloys) due to the impact of high energy particles (such as nitrogen ions) in plasma. The ejected atoms condense on the surface of the substrate creating a thin film.

The third coating method involves coating the Nd—Fe—B based powders with a very fine metal powder of Dy or Tb metal and/or alloys mixed with a solvent. A high velocity jet (about 30 to about 60 ft/sec) is established by accelerating a stream of air or inert gas with a swirl accelerator. By adjusting the flow rate and pressure of the air/gas stream, a laminar flow pattern can be established at Reynolds numbers where turbulent flow would normally occur. The gas is directed to a "coating tube". The swirl accelerator is available from GEA Process Engineering Inc., of Columbia, Md. 21045, for example.

Figure 4:
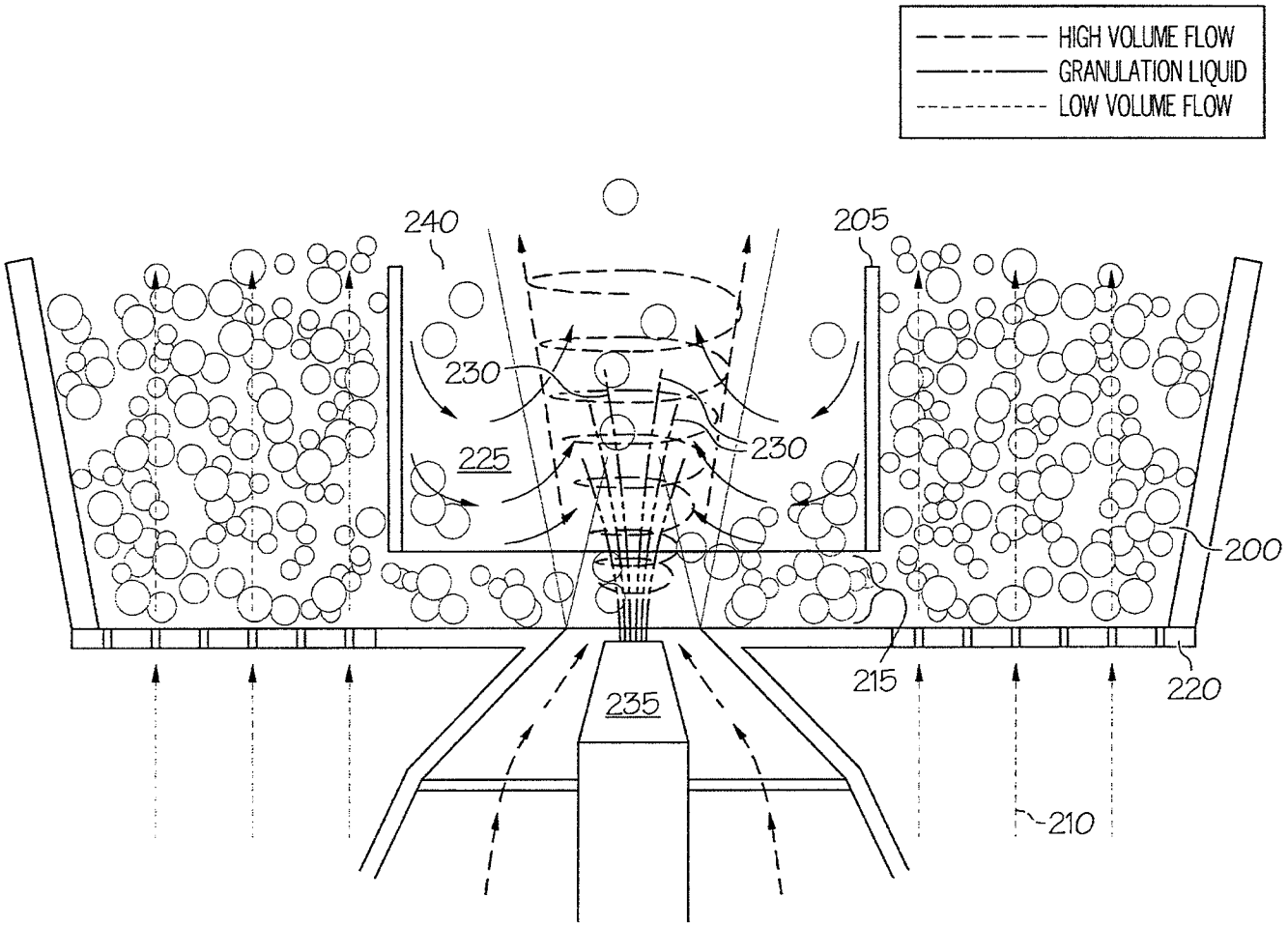
FIG. 4 is a schematic of a swirl coater.

As shown in FIG. 4, a reservoir of the powder to be coated in the area of "down flow bed" 200 surrounds the coating tube 205 and is kept lightly aerated by a low velocity gas stream 210 that enters the powder bed from the bottom. There is a low volume flow in this area. A gap 215 between the inlet fluidizing plate 220 and the bottom of the coating tube 205 under the wetting and contacting zone 225 allows powder to be exposed to the high velocity gas stream. Particles of powder are picked up at this interface and accelerated by the gas stream.

A fine spray 230 of the coating that contains Dy or Tb metal or alloy is introduced into the bottom of the high velocity gas stream through the spray nozzle 235. The coating spray 230 is moving faster than the solid particles so contact occurs and a coating is deposited.

The boundary layer effect causes a velocity gradient from high gas velocity at the center of the tube to zero at the wall. This gradient causes the powder to be tumbled by the gas stream so that all particle surfaces are exposed to the coating spray. Once the coating is applied, the coated particle travels on up the coating tube. The particle velocity is always lower than the gas velocity so there is always a movement of gas across the particle surface. This gas movement evaporates the solvent and dries the coating in the drying zone 240. The particle is substantially dry by the time it reaches the end of the coating tube 205.

At the end of the tube, the particles disengage from the high velocity stream and fall back to the holding area (not shown)

Figure 5:
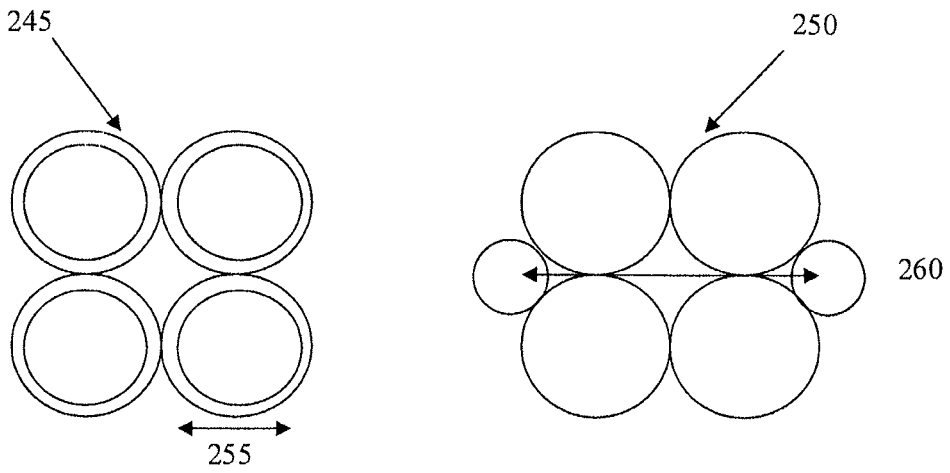
FIG. 5 illustrates particles of a magnetic material showing a core shell and grain boundary as well as limited bulk diffusion.

FIG. 5 shows two methods of powder coating. One method 245 is coating with a core shell structure shown at the top left of FIG. 5, wherein the shell is being coated with Dy rich material and the inner portion is rich in Nd/Fe/B. An example diameter of the coated core is shown 255. The coating can be achieved using a method wherein the particles used are of very different sizes, resulting in substantially full coating around the core; in specific instances there is approximately 100 percent coating as shown in FIG. 5 at left, and in others from about 75 percent to about 100 percent coating, or from about 50 to about 75 percent coating of the core. At right of FIG. 5, a mixed powder method 250 is shown where the particles are of different sizes such that a partial coating occurs; in specific embodiments a coating from about 0 to about 50 percent, and in others from about 0 to about 25 percent or from about 25 to about 50 percent. The large circles and small circles represent a large and small powder, respectively. The small powder is rich in Dy and large powder is rich in Nd/Fe/B. Both the core shell and mixed powder methods can be used in embodiments described herein. The core shell method results in a more uniform distribution of the Dy rich material around each Ne/Fe/B particle. The distance 260 from one small particle to another in an example orientation of particles is shown by the arrow on the right of FIG. 5.

Figure 6:
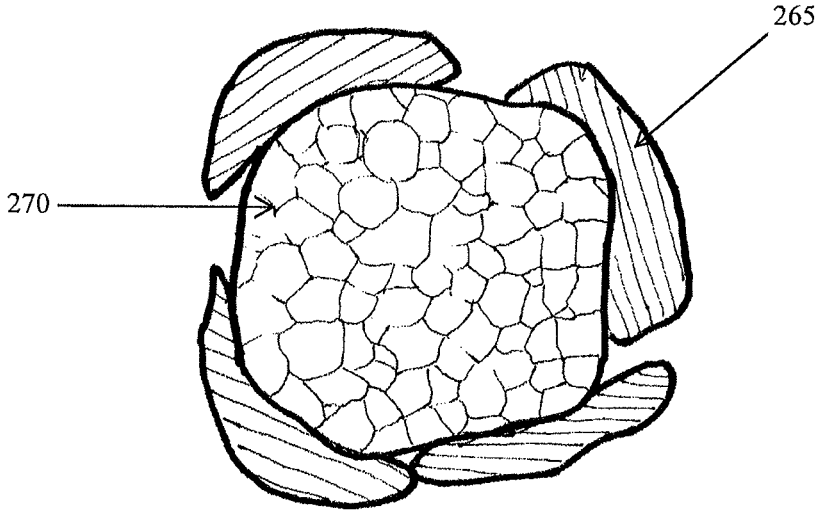
FIG. 6 shows element diffusion.

FIG. 6 illustrates is a schematic of a large view of the image from the right panel of FIG. 5. Shown is one particle of a powder with many grains. The particle is an Nd—Fe—B particle 270, and the Dy rich powder 265 is shown around this (a heavy rare earth rich powder is on the outside). Grains are shown inside the Nd—Fe—B particle. If heated, the Dy distributes via solid diffusion along grains and through grains. In specific embodiments the powder 265 is Dy or Tb or both.

Figure 7:
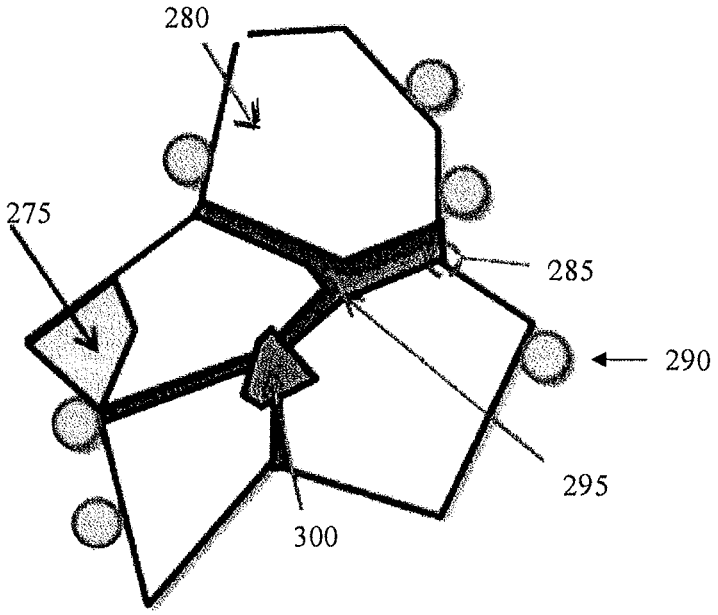
FIG. 7 shows grain boundary diffusion and magnetic phases.

FIG. 7 shows phases: the triple junction phase, the soft magnetic phase, the hard magnet phase, and the grain boundary phase. FIG. 7 demonstrates the great complexity of the grain boundary. The soft magnetic phase (α-Fe) 275 is shown, with the hard magnet phase (Nd2Fe14B) 280, the edge 285, a Dy particle 290, the grain boundary phase (Nd-rich) 295, and the triple junction phase (Nd-rich) 300. Using the hot-pressing method using two powders the core temperature can be lower due to pressure used and which also promotes nonhomogeneous distribution of Dy. Dense areas of Dy (Dy rich layers) will dissipate upon further heating and with further pressing according to the methods described herein to achieve more uniform distribution of the Dy particles so that less Dy can be used to achieve the same results. With hot-pressing, the Dy distributes along the grain boundary; ideally Dy within grains is minimized.

Examples of Hot Pressing and Heat Treatment Processes:

A hot pressing method can include: using the powder mixture with desired composition, forming the magnet parts in a shaped mold under a magnetic field (about 1 to about 2.5 Tesla (T)), in vacuum (about 10 to about 2 torr) or under inert atmosphere (Ar or N2); heating the part slowly from room temperature to the hot pressing temperature, maintaining a temperature of about 500° C. to about 850° C. for about 0.5 to about 2 hours. In specific embodiments the time from the start of heating at room temperature to the end of the heating within the range of about 500° C. to about 850° C., and in other specific embodiments the time to reach the range of about 500° C. to about 850° C. takes 1.5-2 hours (wherein additional heating of about 0.5 to about 2 hours can be performed). The time for hot pressing can in specific embodiments be from about 30 minutes about 40 minutes or about 50 minutes to about 1 hour or from about 1 hour to about 2 hours. Hot press in a die at about 30 to about 90 Megapascals (MPa) (typical about 50 to about 80 MPa) for from about 3 to about 20 minutes, and in specific embodiments can be from about 5 to about 10 minutes. In specific embodiments part density of over 85% of theoretical density is achieved (theoretical density: 7.6 g/cm3). In vacuum (about 10 to about 2 torr) or under inert atmosphere (Ar or N2). Slowly cool down for 1 to 5 hours, or continue the aging heat treatment. The aging heat treatment temperature: about 600° C. to about 1000° C. (for time: for example, about 0.5 to about 8 hours). Cooling can be performed before the aging step, or the aging can be done directly after hot pressing without cooling between. In vacuum (about 10 to about 2 torr) or under inert atmosphere (Ar or N2). This may involve multi-steps at various temperatures and time durations to maximize grain boundary diffusion and minimize bulk diffusion of Dy or other HREs.

For the parts undergoing hot deformation or die-upset. The magnetic field during part forming is not necessary since the particle alignment is realized during hot deformation or die-upset. The hot deformation temperature: from about 550° C. to about 900° C.; in specific embodiments the range is from about 700° C. to about 850° C.

An example: A vacuum hot press/die upset of blended Nd2Fe14B+Dy2Fe14B ribbons shows a non-uniform Dy distribution (blended Dy2.37Fe+Nd2.7Fe14B powders). This hot press of blended powders approach is in parallel with the hot press/die upset process.

In specific embodiments each particle of Nd2Fe14B based magnetic material may contain other elements such as Co, Ga, Cu, Pr, Dy, Tb etc. The particle is surrounded by Dy and/or Tb enriched particles such as Dy—Fe, Dy—Tb—Fe, Dy—Nd—Fe—B, Dy—Tb—Nd—Pr—Fe—Co—Ga—B etc. The HRE enriched particles can be either mechanically mixed and milled with the Nd2Fe14B base particles, or coated with PVD, CVD or other methods (core shell). The further consolidation is achieved through both heating and pressing, which promotes the grain boundary diffusion ($D_B$) with limited bulk diffusion (D).

The core-shell approach would require individually Dy coated Nd2Fe14B powders while mixed powder approach would be possible using mechanically mixed powders. In each case, a characteristic length, L, between Dy rich regions is developed. This diffusion length scale along with D and $D_B$ is very important in controlling a significant grain surface enrichment of Dy.

Nd—Fe—B permanent magnets can be produced using a hot pressing plus aging heat treatment process, which involves making powders with desired chemical composition. A typical process includes weighing and pressing under a magnetic field for powder alignment and aging. Specifically, the powder is partially compacted and magnetically aligned in a first press equipped with magnetizing means. It is then transported to a second press where it is heated and pressed under high loads. Alternatively, the part thus formed can be further pressed to form a specific shape with aligned grain structures although the forming under magnetic field is not necessary in this case.

Die-Upset Example

In yet another example die-upset is used to create a magnet. In a non-limiting method of die-upset, the powder is deformed from about 20 to about 80 percent; in specific embodiments the deformation is from about 40 to about 80 percent; in specific embodiments the deformation is from about 50 percent to about 60 percent or from about 60 percent to about 70 percent or from about 70 percent to about 80 percent. In normal hot pressing the deformation is at most 10 percent and usually less, such as 2-3 percent. In specific examples of a die-upset method, a high deformation process is used such that powder does not have to be prealigned in a magnetic field prior to pressing. When such a large deformation occurs (about 20 percent to about 80 percent) the grain magnetically aligns as if it had been under a magnet field. Therefore this method provides surprising advantages. In specific embodiments powder or powders are slowly pressed together to form a shape such as a cylinder, then the cylinder is heated and pressed such that the cylinder becomes flatter. The shape can change, and the grains realign.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "device" is utilized herein to represent a combination of components and individual components, regardless of whether the components are combined with other components. For example, a "device" according to the present invention may comprise an electrochemical conversion assembly or fuel cell, a vehicle incorporating an electrochemical conversion assembly according to the present invention, etc.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

In specific embodiments one or more of the methods, or magnetic materials or permanent magnets can include or be produced by or can herein include one or more of: a magnetic field from about 1 to about 2.5 Tesla (T); heating of a magnetic material comprising heating a magnetic material and maintaining a temperature within the second range of from about 500° C. to about 850° C. for from about 0.5 to about 2 hours; a vacuum comprising from about 10 to about 2 torr; an inert atmosphere can comprise Ar or N2; hot pressing from about 30 to about 90 Megapascals (MPa); hot pressing from about 50 to about 80 Megapascals (MPa); cooling from about 1 to about 5 hours; a powder material from about 5 to about 80 wt % dysprosium; powder that is flake-shaped; removing by screening flake-shaped powder that did not coat, prior to the forming the magnetic material; cooling from about 5° C. to about 35° C.; an aging heat treatment after hot pressing and prior to cooling, the aging heat treatment comprising heating at from about 550° C. to about 1000° C. for from about 0.5 to about 8 hours in a vacuum at about 10 to about 2 torr under an inert atmosphere containing Ar or N2; methods can comprise, after combining a first material with a second material, the second material forming a layer thickness of about 1 to about 100 micrometers; combining a first material with a second material, the second material forming a layer thickness of about 10 to about 50 micrometers; a second heating can range from about 700° C. to about 850° or from about 650° C. to about 750° C.; and/or a method can comprise cooling a solid material in a vacuum under inert atmosphere for from about 1 to about 5 hours after hot pressing the solid material and before deforming the solid material.

What is claimed is:

1. A method of making a magnetic material for a permanent magnet using hot pressing comprising:

providing:

a first material in the form of a core powder containing Nd, Fe and B;

a second material in the form of a surface powder containing Dy, Tb, or both in metallic alloy form;

combining and mechanically milling the first material with the second material such that the first material is substantially coated with a layer of the second material, wherein the combined materials are milled with sufficient energy to result in mechanical alloying between the first material and the second material;

forming the coated first material in a shaped mold under a first magnetic field in a vacuum or under an inert atmosphere;

heating the formed coated first material from a first range of about 5° C. to about 35° C. to a second range of about 500° C. to about 850° C.;

hot pressing the formed coated first material under a second magnetic field in a die to achieve a deformation of not more than ten percent; and cooling the pressed coated first material in the vacuum or under an inert atmosphere for from about 1 to about 5 hours.

2. The method of claim 1 wherein each of the first magnetic field and the second magnetic field is from about 1 to about 2.5 Tesla (T).

3. The method of claim 1 wherein heating the coated first material comprises heating the coated first material and maintaining a temperature within the second range of from about 500° C. to about 850° C. for from about 0.5 to about 2 hours.

4. The method of claim 1 wherein the vacuum comprises from about 10 to about 2 torr.

5. The method of claim 1 wherein the inert atmosphere comprises Ar or N2.

6. The method of claim 1 wherein the hot pressing comprises from about 30 to about 90 Megapascals (MPa).

7. The method of claim 1 wherein the hot pressing comprises from about 50 to about 80 Megapascals (MPa).

8. The method of claim 1 wherein the second material comprises from about 5 to about 80 wt % dysprosium.

9. The method of claim 1 wherein the second material powder is flake-shaped.

10. The method of claim 9, further comprising removing by screening the flake-shaped powder that did not coat, prior to the forming the coated first material.

11. The method of claim 1 wherein the cooling comprises cooling to from about 5° C. to about 35° C.

12. The method of claim 1 further comprising an aging heat treatment after the hot pressing and prior to the cooling, the aging heat treatment comprising heating at from about 500° C. to about 1000° C. for from about 0.5 to about 8 hours in a vacuum at about 10 to about 2 torr or under an inert atmosphere containing Ar or N2.

13. The method of claim 1 wherein after combining the first material with the second material, the thickness of the layer of the second material is about 1 to about 100 micrometers.

14. The method of claim 1 wherein after combining the first material with the second material, the thickness of the layer of the second material is about 10 to about 50 micrometers.

* * * * *